US006978720B2

(12) United States Patent
Johnson

(10) Patent No.: US 6,978,720 B2
(45) Date of Patent: Dec. 27, 2005

(54) GONDOLA RAILCAR CONSTRUCTION

(76) Inventor: Kent N. Johnson, 178 Seven Forks Rd., Martin, GA (US) 30557

( * ) Notice: Subject to any disclaimer, the term of this patent is extended or adjusted under 35 U.S.C. 154(b) by 0 days.

(21) Appl. No.: 10/695,558

(22) Filed: Oct. 28, 2003

(65) Prior Publication Data

US 2005/0087097 A1 Apr. 28, 2005

(51) Int. Cl.[7] ..... B61D 3/00
(52) U.S. Cl. ..... 105/380; 105/406.1; 105/411; 105/419
(58) Field of Search ..... 105/380, 381, 105/382, 383, 384, 385, 386, 787, 389, 390, 105/392, 406.1, 411, 419; 52/436.2, 736.1, 52/737.2, 726.3, 726.1, 726.9

(56) References Cited

U.S. PATENT DOCUMENTS 821,490 A * 5/1906 Herrmann ..... 105/380
827,266 A * 7/1906 Sage ..... 105/380
860,029 A * 7/1907 Irwin ..... 105/380
1,261,604 A * 4/1918 Pearson ..... 105/380
3,605,634 A 9/1971 Johnson
3,605,635 A 9/1971 Stark
3,769,918 A 11/1973 Przyblinski et al.
3,866,545 A 2/1975 Heap
4,356,776 A 11/1982 Brodeur et al.
4,417,526 A 11/1983 Marulic et al.
5,341,747 A 8/1994 Fetterman et al.
5,388,529 A 2/1995 Tieberghien et al.
5,813,353 A 9/1998 Sauter

* cited by examiner

*Primary Examiner*—Mark T. Le
(74) *Attorney, Agent, or Firm*—Hodgson Russ LLP

(57) ABSTRACT

A gondola railcar having a plurality of side posts connected to the underframe for a high strength construction. The underframe includes a plurality of cross-bearing members having an upper flange, a lower flange and at least one vertical web connecting the two flanges. The upper flange has an opening disposed therein that receives the side post such that the side post abuts with the upper flange inside the opening. The side post also abuts with an end of the vertical web, and an end portion of the side post abuts with the lower flange of the cross-bearing member.

18 Claims, 10 Drawing Sheets

GONDOLA RAILCAR CONSTRUCTION

FIELD OF INVENTION

This invention relates to a railroad gondola car, and particularly an improved railroad gondola car having enhanced lateral load strength, especially in the area of the connection between the side walls of the car and the subframe.

BACKGROUND OF THE INVENTION

A number of different types of railroad cars are available, particularly categorized according to the type of cargo for which they are intended. The type of cargo dictates a number of requirements such as cubic foot capacity, floor strength, side wall strength, covered or uncovered, and so forth.

Gondola cars are typically open or uncovered vehicles and are used to carry a large variety of industrial cargo. But even within the category of gondola railcars, several different types are available, again depending upon the type of cargo to be handled. Specifically, some gondola cars are designed to carry wood chips and similar products of relatively low density, while other gondola cars carry such products as coal which is of relatively higher density. So called "mill" gondola cars are commonly used around steel mills and are intended for carrying such cargos as steel scrap, slag, or steel sheet. With regard to steel sheet, quite often the sheet may be wider than the gondola car, and would therefore be loaded into the gondola car diagonally, i.e., extending from one lower corner of the car to the opposite upper corner of the car. Mill gondola cars, therefore, require a very high lateral load strength. Because of the types of loads carried and the manner of unloading cars such as with clam shell buckets or magnets, most cars cannot have any interior bracing.

Experience has shown that mill gondola cars are subject to extreme abuse, with most typical structural failures occurring at the connection of the side to the underframe at the side post interface. Analysis of various car constructions has confirmed that the connection of the side post and the underframe is one of the most critical areas of the car.

Typically such gondola cars are constructed in stages wherein the subframe and floor assembly is first made and the side assembly is separately made. The side assembly includes a number of vertical channel or hatshaped posts for reinforcing the side, and these assemblies are attached to the subframe assembly, with the side posts being either bolted or welded to the subframe assembly. Because typically no internal lateral reinforcement is used in a mill gondola car, lateral loads on the side walls of the car tend to tear the side posts away from the subframe assembly.

Gondola cars carrying less dense materials are often flood loaded from the top and unloaded by rotating the car and dumping from the top. There is a demand to transport commodities such as low density scrap and demolition material in cars without interior bracing so they can be loaded and unloaded similar to mill gondolas. The loading/unloading buckets impact the car bodies much like mill gondolas causing substantial damage. Also, the cars are typically longer and higher because of the lower density commodity.

Because internal bracing is disfavored in these type of cars, the lateral loads have to be transferred down the posts into the underframe. These loads include lateral unloading/loading impacts.

Accordingly, there is a need to develop a better moment connection between the posts and the underframe.

SUMMARY OF THE INVENTION

The present invention meets the above-described need by providing larger and higher cars, for the same specification loadings as mill gondolas, with an improved connection between the side posts and the underframe.

Generally described, the invention provides for a high strength connection between the side and the underframe for a mill car. The side posts are connected to a typical cross bearing member or bolster. A top cover portion of the cross bearing or bolster extends around the inside face of the post with a cutout that partially or completely surrounds the post. Connecting the side post directly to the cross bearing member in this manner provides a simple, high strength connection that addresses the main area of structural failure of mill cars of this type.

In a preferred embodiment the side post that supports the side walls is connected to the underframe in the following manner. The underframe comprises a plurality of horizontal cross beams that extend from one side of the railcar to the other. The cross beams have a first flange and a second flange connected by at least one web. In a cross-section taken along the longitudinal axis of the beam, the flanges and the web form the shape of an "I." These beams or girders are well known in the art and are commonly referred to as "I" beams, however beams having multiple webs are also suitable.

In the present invention the flanges extend beyond the web along the longitudinal axis at both ends. The first flange has an opening defined therein at each end for receiving the post. The post is constructed of hollow tubing or U-shaped channel and slides through the opening in the first flange until the bottom of the post abuts with the second flange. The post also abuts with the edge of the vertical web.

The side post to underframe connection of the present invention is constructed by welding the post to the cross beam in the following manner. The interface between the side walls of the post and the inner edge of the opening in the first flange are welded. The side wall of the post is welded to the edge of the web, and the bottom of the post is welded to the second flange.

Alternate embodiments of the invention include different shapes for the side post and different cross-sectional profiles for the cross bearing member. For example, the side post may be square, rectangular, U-shaped, hat-shaped, etc. The cross-sectional shape of the cross-bearing member can include other profiles in addition to the I-shaped beam. For example, the beam may have multiple vertical webs connecting the top and bottom flanges. Also, the top flange that surrounds the side post may be formed integrally in a structural beam or it may be constructed from an additional member that attaches to the cross-bearing member.

Accordingly, the present invention provides a high strength connection between the side posts and the underframe for a mill gondola car. The connection advantageously strengthens the gondola car without the need for internal bracing.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
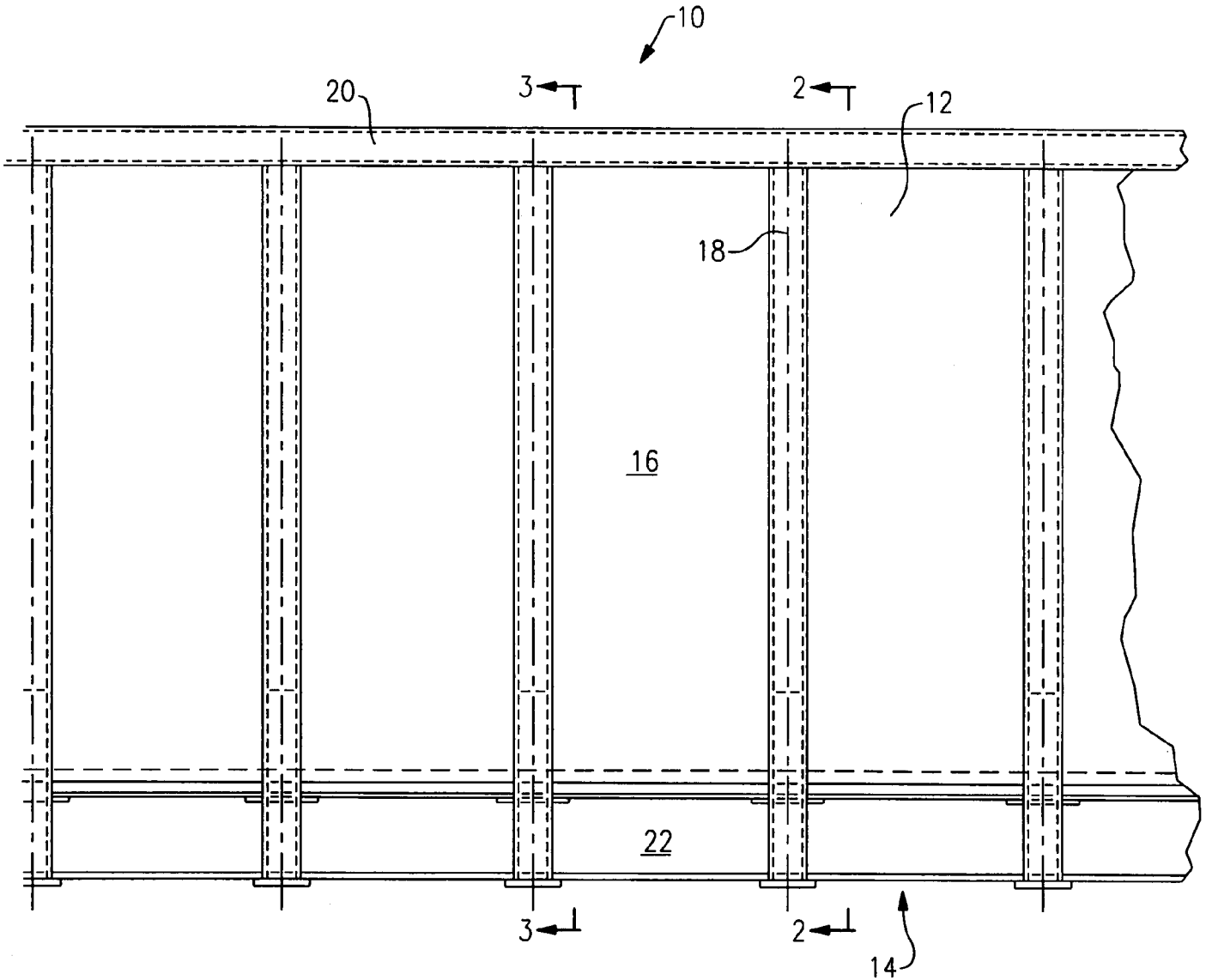
FIG. 1 is a partial side elevation view of a gondola railcar body.

Referring to FIG. 1, a gondola car generally designated 10 includes a side frame assembly 12 and a subframe or underframe assembly 14. The side frame assembly 12 includes a side sheet 16 of a suitable thickness and material such as ¼" steel sheet that extends along the length of the car and is of an appropriate height for the density of the commodities to be transported and the gross rail capacity of the vehicle. The side frame assembly 12 also includes a plurality of vertical side posts 18 that preferably comprise a U-shaped profile member having a pair of parallel side walls connected by a back wall. A preferred construction is 5¾" deep and 6" wide and having a ⅜" wall thickness. The side post can be designed with various dimensions depending on the particular application. The side post 18 is preferably a tubular structural steel member and may have many different cross-sectional shapes including square, rectangular, U-shaped, hat-shaped, etc. A top lateral member 20 extends along the length of the side. The top lateral member 20 is preferably hollow, square tubing having dimensions of 6"×6" by ½" thick. The gondola car 10 also has bolsters (shown in FIGS. 4 and 5) for mounting the car 10 on a pair of trucks as known to those of ordinary skill in the art. Lateral support members 22 also extend between side posts 18 in the subframe 14.

Figure 2:
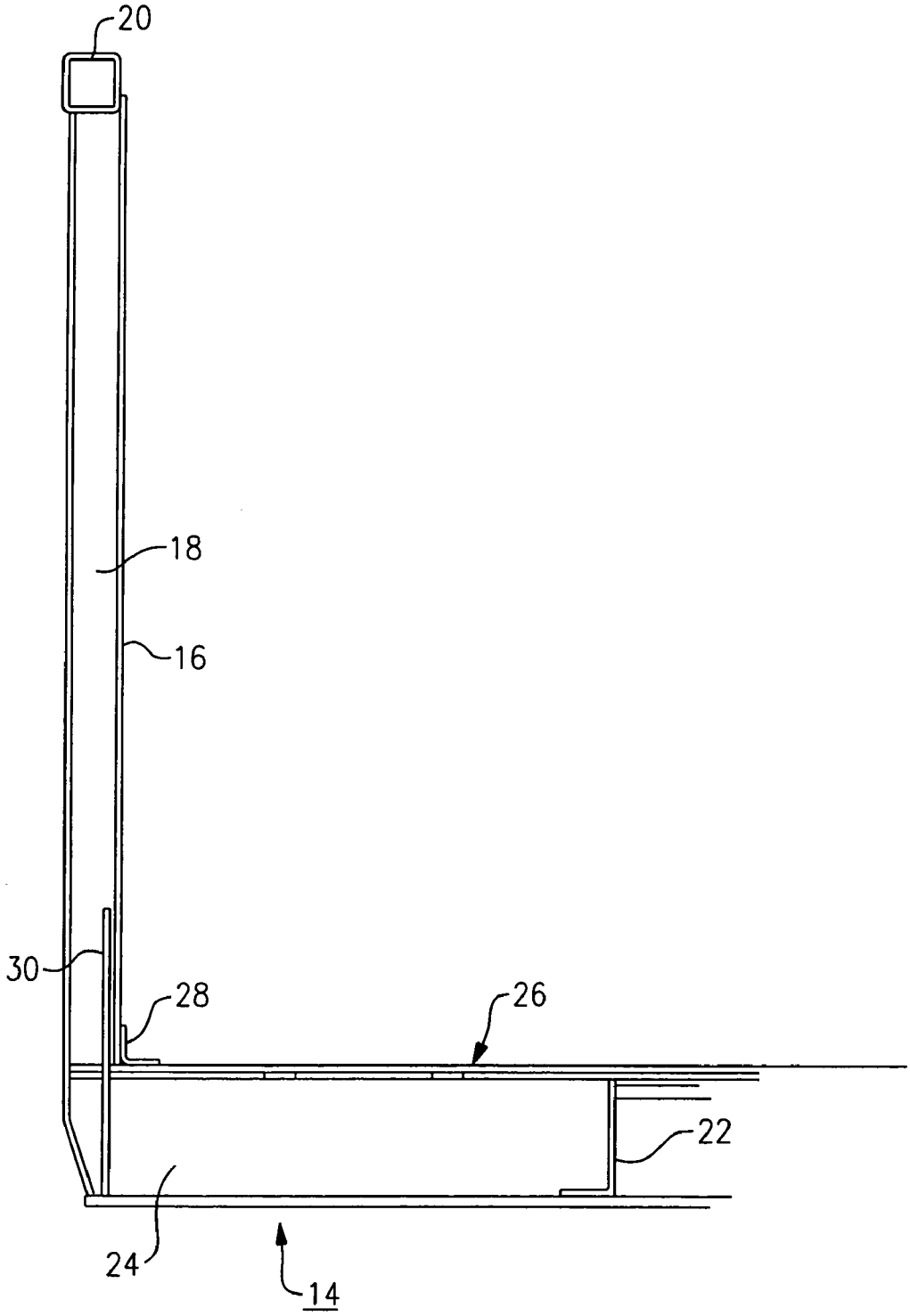
FIG. 2 is a sectional side view taken along line 2—2 of FIG. 1.

Turning to FIG. 2, each of the side posts 18 preferably connects to the underframe in the following manner. The side post 18 abuts with the lateral member 20 at the top. The lateral member 20 is preferably constructed out of square steel tubing. At the bottom, the side post 18 tapers down on one side and connects to a cross-bearing member or beam 24. The tapering of post 18 is optional and the side post 18 may also be comprised of a straight wall. Cross-bearing member 24 is preferably an I-beam that extends underneath the floor 26 to form the subframe assembly 14 and to connect the two side frame assemblies 12. Other shapes would also be suitable, for instance the cross beam could have multiple vertical webs. An angled member 28 is disposed along the edge where the side sheet 16 and the floor 26 converge.

A reinforcing member 30 can be disposed inside the post 18 and preferably extends from the subframe 14 upward along a portion of the side. The reinforcing member 30 reinforces the connection between the side assembly and the underframe which is a critical area with regard to failures. The reinforcing member 30 preferably comprises a flat steel plate of sufficient thickness for rigidity and of sufficient width to approximately match the inside dimension of the side post 18. The plate is preferably three-eighths (⅜") of an inch thick.

Figure 3:
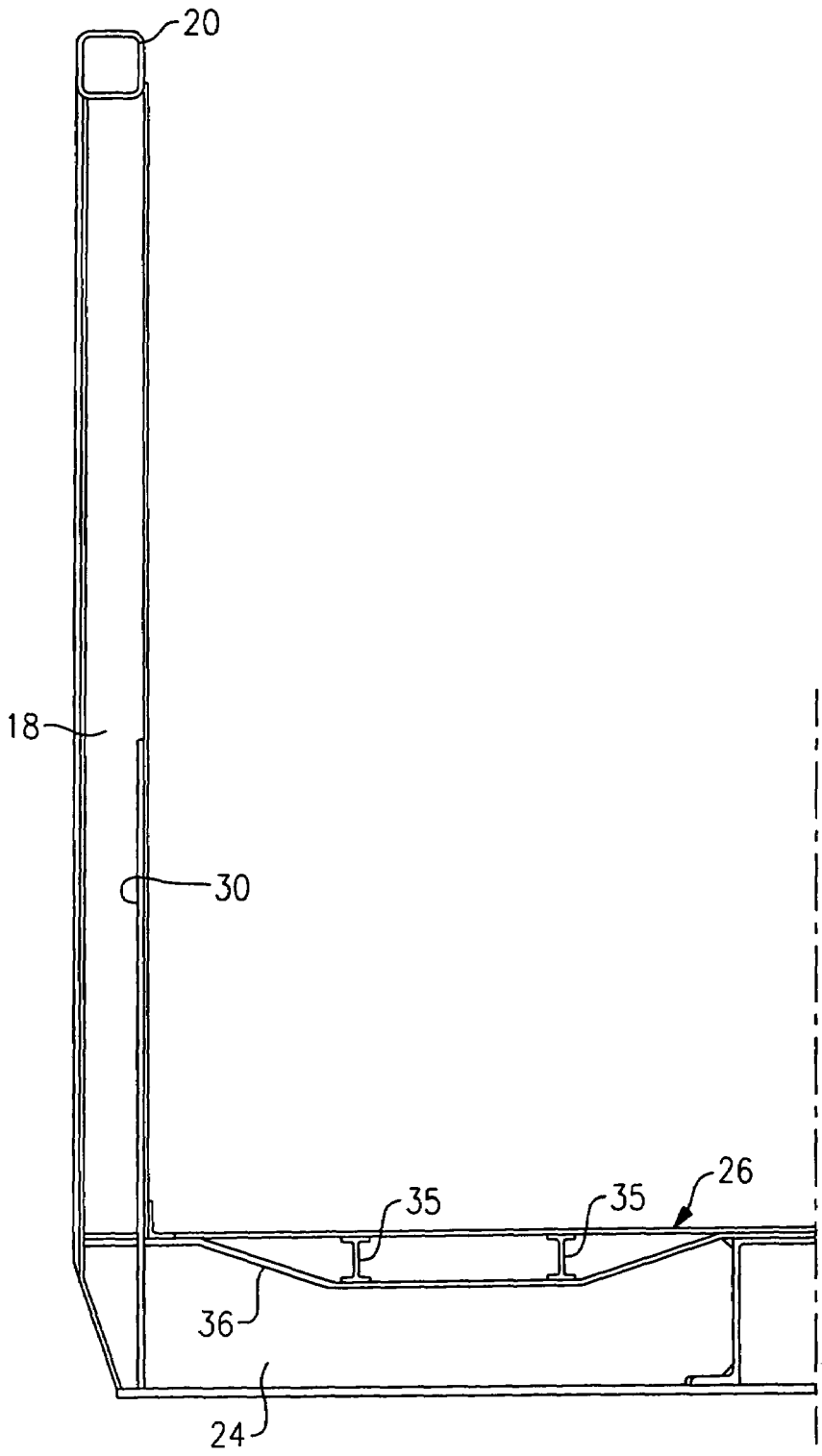
FIG. 3 is a sectional view taken along line 3—3 of FIG. 1 showing a cross-bearing member with stringers.

Turning to FIG. 3, additional support may be provided by stringers 35 that extend across an angled portion 36 of the cross-bearing members 24 underneath the floor 26.

Figure 4:
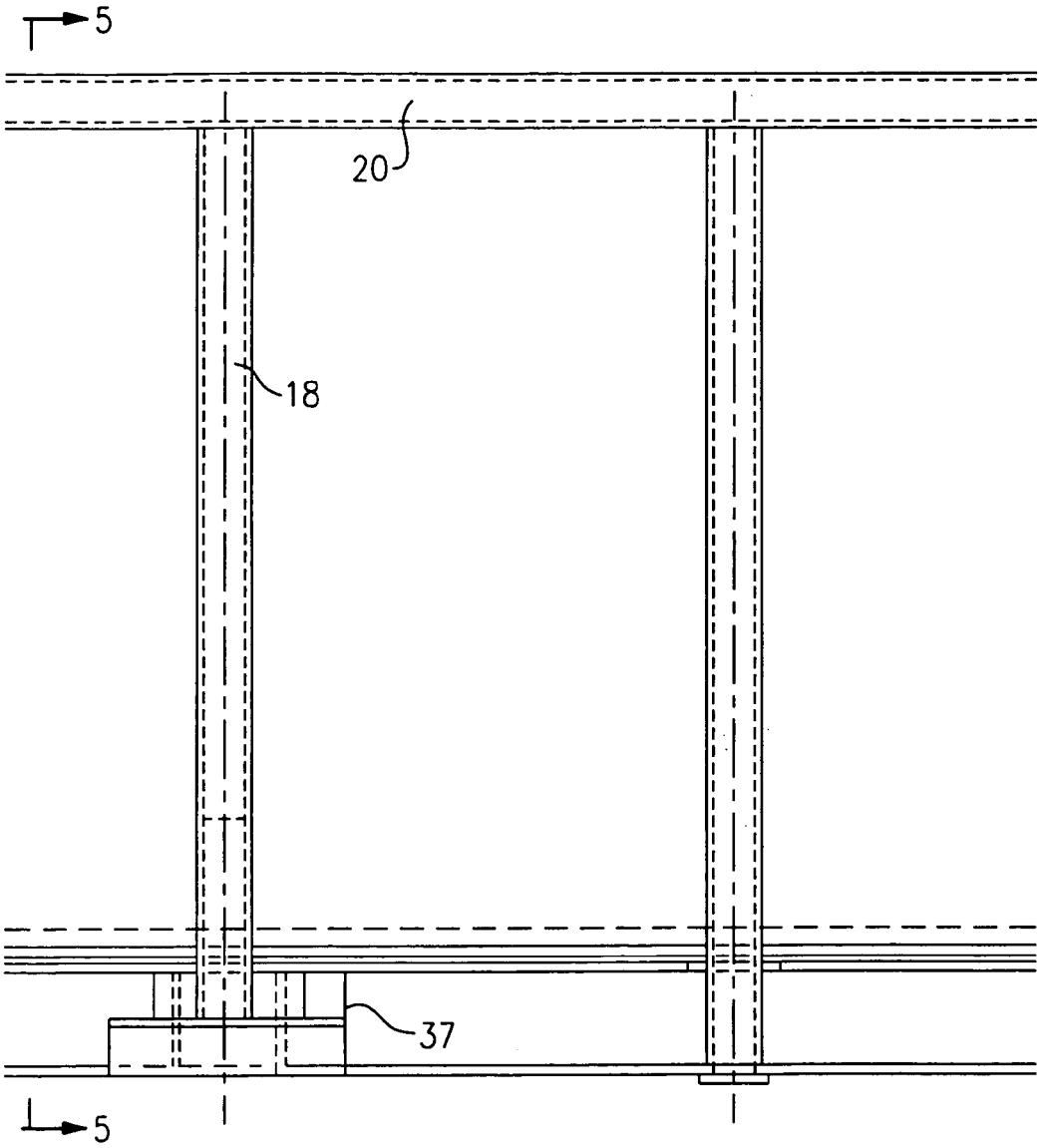
FIG. 4 is a partial side elevation view of a gondola railcar body having a bolster.
Figure 5:
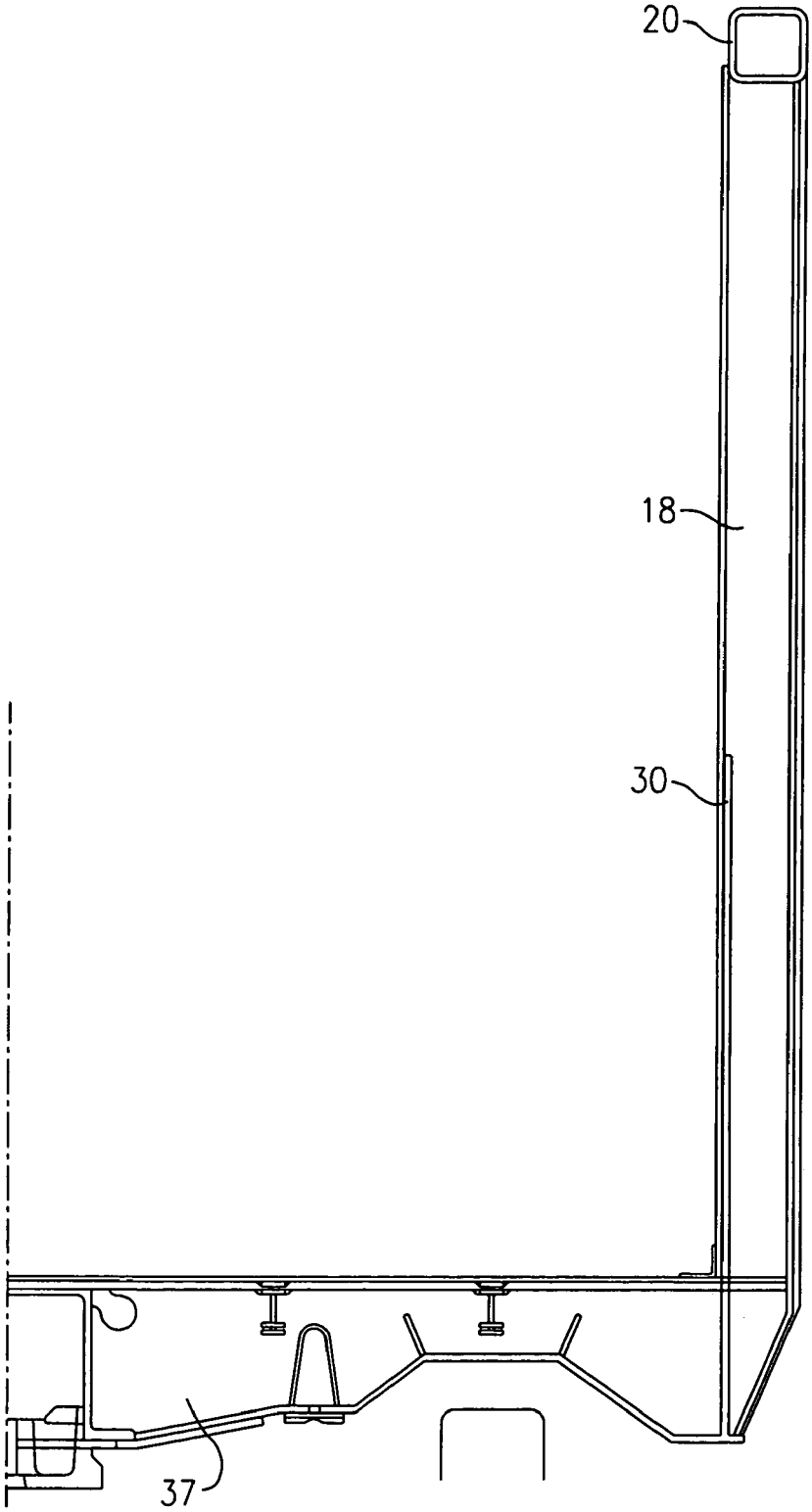
FIG. 5 is a section view taken along line 5—5 of FIG. 4.

In FIG. 4, the side of a railcar is shown having a bolster 37 for connection to a truck as known to those of ordinary skill in the art. Turning to FIG. 5, a side view of a typical bolster 37 is shown. Accordingly, the connection between the side post and the underframe of the present invention can be utilized at the side post located at the bolster 37 in the same manner as described below.

Figure 6:
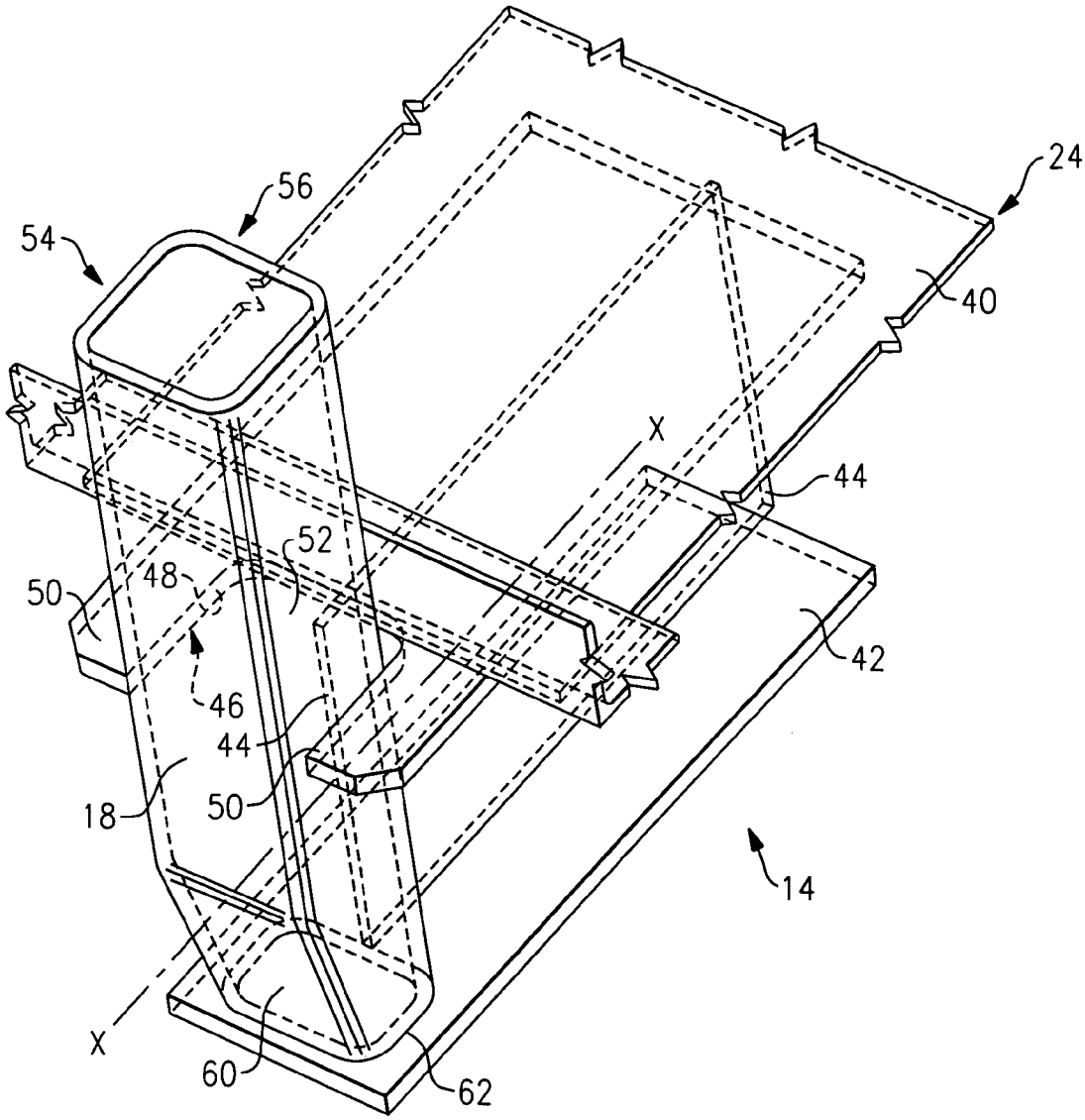
FIG. 6 is a perspective view of the connection between the side post and underframe.

In FIG. 6, the connection between the side post 18 and the subframe assembly 14 is shown in detail. The cross-bearing member 24 may take different shapes but is preferably constructed of a steel I-beam having an upper flange 40, a lower flange 42, and at least one vertical web 44. The upper flange is preferably ⅜" thick by 8 inches wide. The upper flange 40 preferably extends along a longitudinal axis X beyond the web 44. The upper flange 40 has an opening 46 where material is removed therefrom. The opening 46 is defined by an edge 48 that is curved to conform to the shape of the side post 18 such that the side post fits in the opening 46 with portions 50 of the flange 40 extending around the post 18. The portions 50 extend around opposite faces 52,54 of the post 18. An inside face 56 of post 18 abuts with the vertical web 44.

The bottom of the post 18 is preferably tapered along the outside face 60, however it may also consist of a continuous straight wall. The bottom 62 of the post preferably abuts with the lower flange 42 of cross-bearing member 24 for additional strength. The lower flange is preferably ¾" thick by 8 inches wide.

The side post 18 is preferably welded to the edge 48 defining opening 46. The post 18 is also welded to the vertical web 44 along its inside face 56. Also, the bottom 62 is welded to the lower flange 42.

Figure 7:
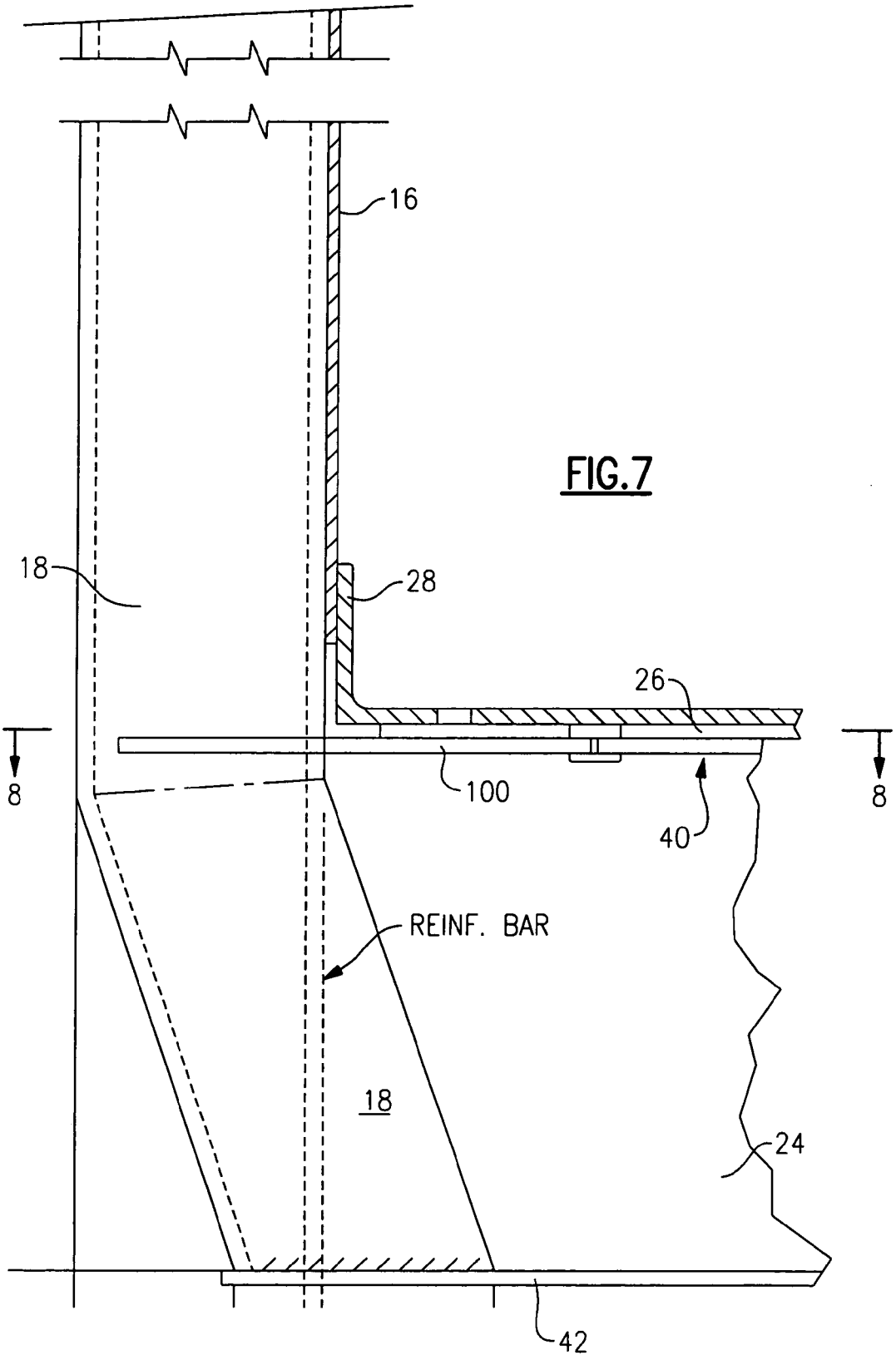
FIG. 7 is a side view of a first alternate embodiment of the present invention with a two-piece construction for the top flange.
Figure 8:
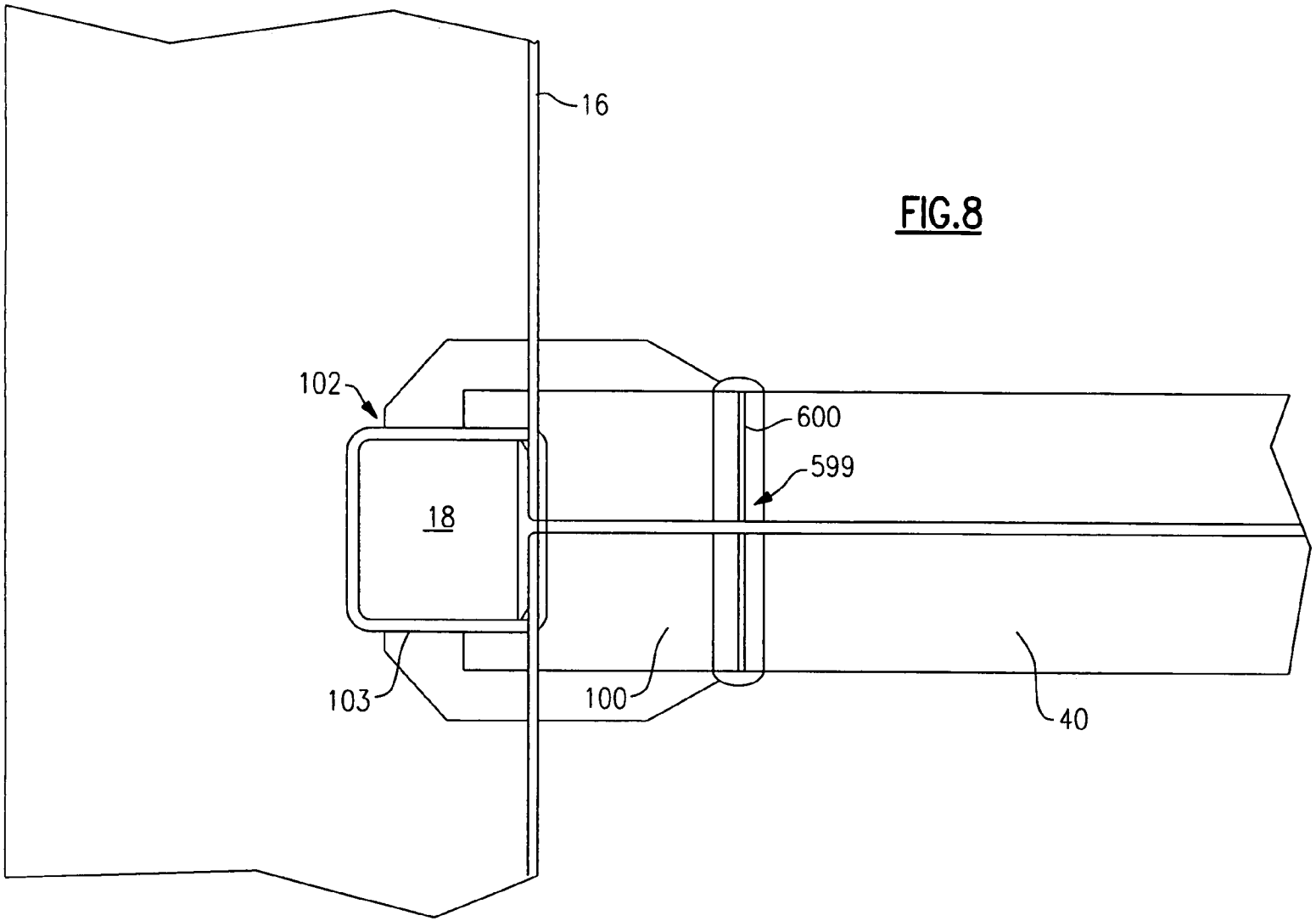
FIG. 8 is a sectional view taken along lines 8—8 of FIG. 7.

Turning to FIG. 7, an alternate embodiment of the present invention provides for a cross-bearing member 24 construction wherein the top flange 40 comprises more than one piece. A cut out in the floor 26 of the car provides access to the cross-bearing member 24 for attachment of an auxiliary flange 100. The auxiliary flange 100 can be welded or mechanically fastened to the cross-bearing member 24. An advantage of the two-piece top flange 40 construction is that it provides flexibility for adjusting to misalignment. As shown in FIG. 8, the auxiliary flange 100 is preferably welded or mechanically fastened along a seam 599 to the flange 40 on the cross-bearing member 24 inside an opening 600 in the floor 26. The flange 100 has an opening 102 bounded by an edge 103. The side post 18 is preferably welded along the edge 103. Also, the reinforcing member 30 can be disposed inside the side post 18 and can extend across the junction between the side post 18 and the underframe for extra support. The flange 100 is welded after the installation of the sides so that it can be moved to line up with the side posts 18. Slots in the floor plate provide access to the weld joint.

Figure 9:
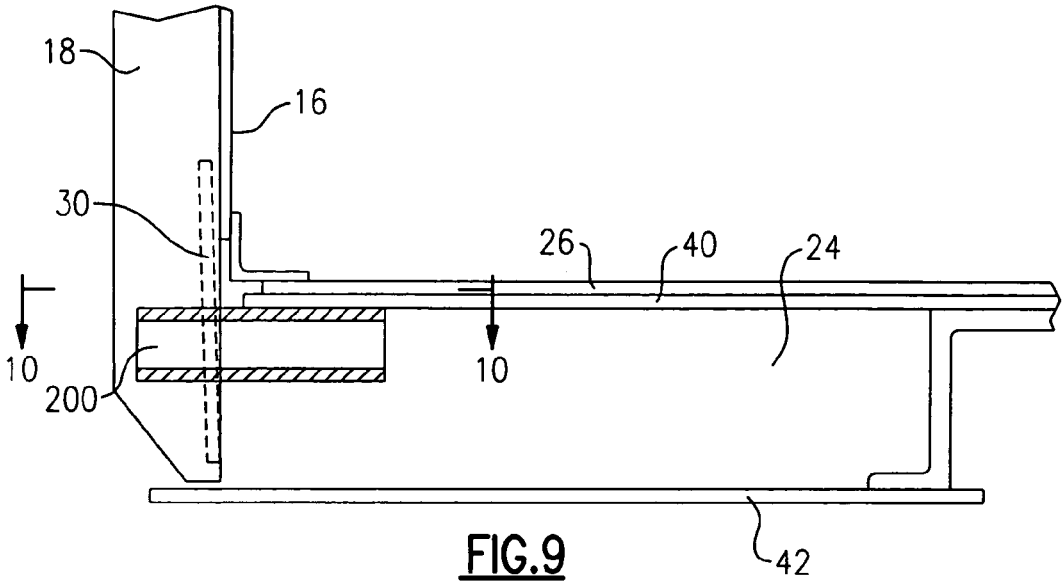
FIG. 9 is a side view of a second alternate embodiment of the present invention with a two-piece construction for the top flange.
Figure 10:
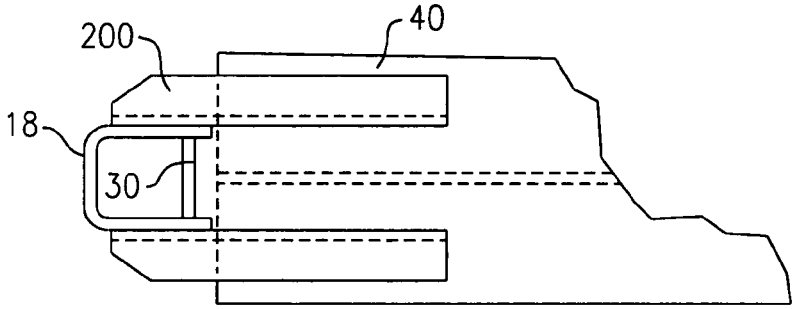
FIG. 10 is a sectional view taken along lines 10—10 of FIG. 9.

In FIG. 9, another alternate embodiment of the invention provides for an extension flange 200 that attaches to the underside of the existing top flange 40 and extends beyond and around the side post 18. Turning to FIG. 10, the extension flange 200 is shown as it connects underneath the flange 40 of the cross bearing member 24 and extends around the sides of the side post 18.

Figure 11:
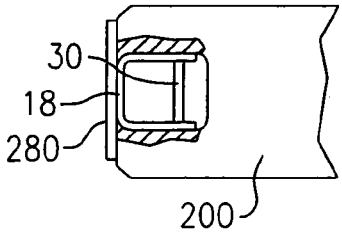
FIG. 11 is a top view of the side post showing an auxiliary member.

Turning to FIG. 11, an auxiliary support member 300 can be attached to flange 200 to completely surround the post 18. The reinforcing member 30 is shown inside the side post 18 in FIGS. 10–11.

In any of the foregoing embodiments, the two sides of the top flange 40 that extend around the side post 18 can be connected around the back of the side post 18 for additional security.

Figure 12:
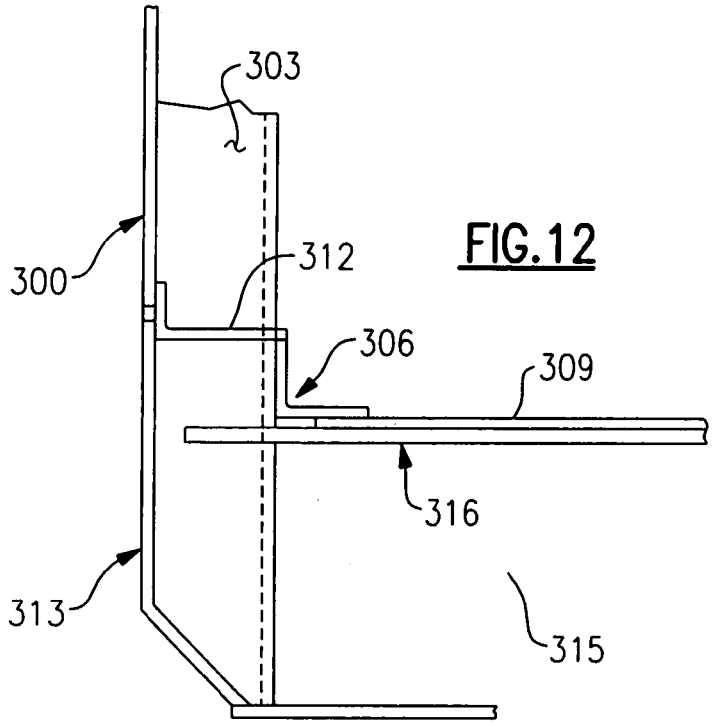
FIG. 12 is a partial side elevational view of an alternate embodiment of the invention.

Although the present invention is described above in connection with external side posts, as shown in FIG. 12 the invention may also be utilized with internal side posts. Side sheet 300 is attached to the opposite side of the posts 303 such that the posts 303 are disposed inside the railcar. A side sill 306 extends across the front of the posts 303 at the point where the floor 309 abuts the post 303. Between the posts 303, an angled member 312 extends from the side sill 306. As shown it extends to the side sheet 300. A reinforcing member 313 is disposed adjacent to the side post 306. The top flange 316 of cross bearing member 315 ties into the post 306 as described above in connection with the other embodiments. As will be evident to those of ordinary skill in the art, the floor 309 may be attached to the cross bearing 315 by means of welding through slots (not shown) in the floor 309 or the like.

Figure 13:
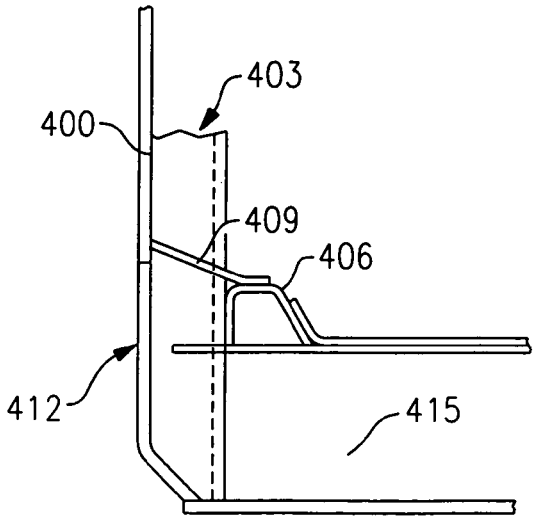
FIG. 13 is a partial side elevational view of another alternate embodiment of the side post; and, FIG. 14 is a side view of an alternate embodiment of the side post.

In FIG. 13, another alternate embodiment with an internal post arrangement is shown. The side sheet 400 is disposed on the outside of side posts 403. A side sill 406 extends across the side of the car and is disposed adjacent to the side posts 403. An angled member 409 extends from the side wall to the side sill 406 between the posts 403. The angled member 409 covers the opening between the posts. A reinforcing member 412 is disposed adjacent to the side post 403. A cross bearing member 415 ties into the post 403 as described above in connection with the other embodiments.

Figure 14:
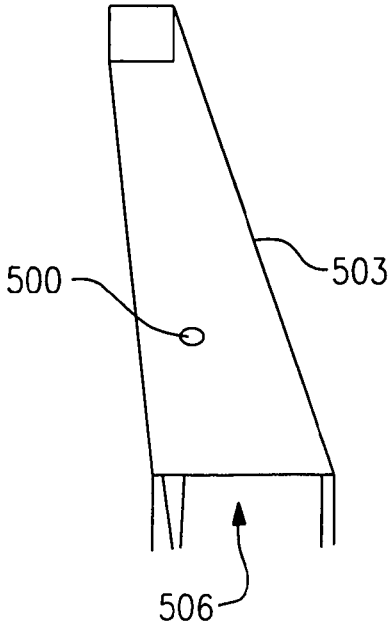
Figure 1:
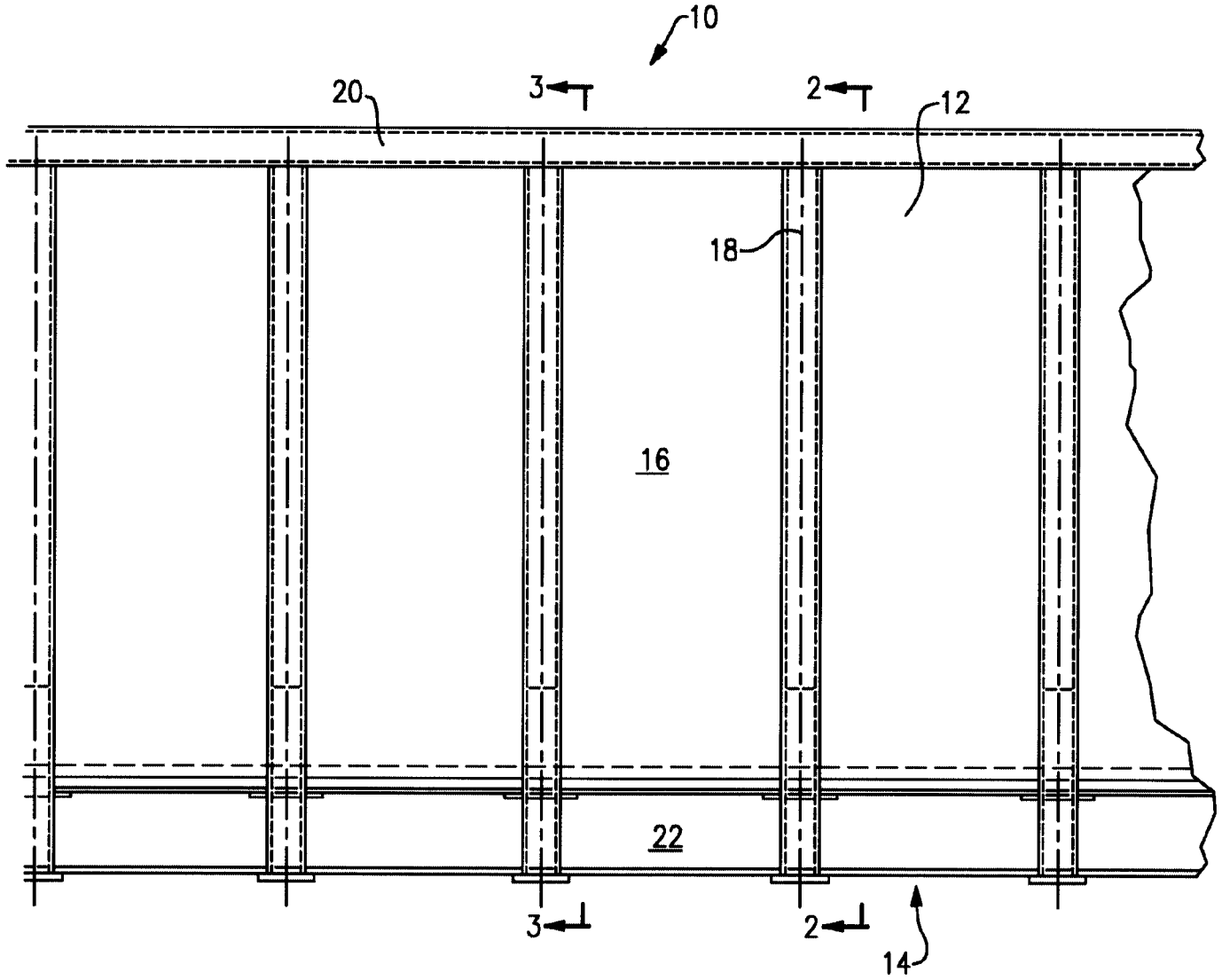
Figure 2:
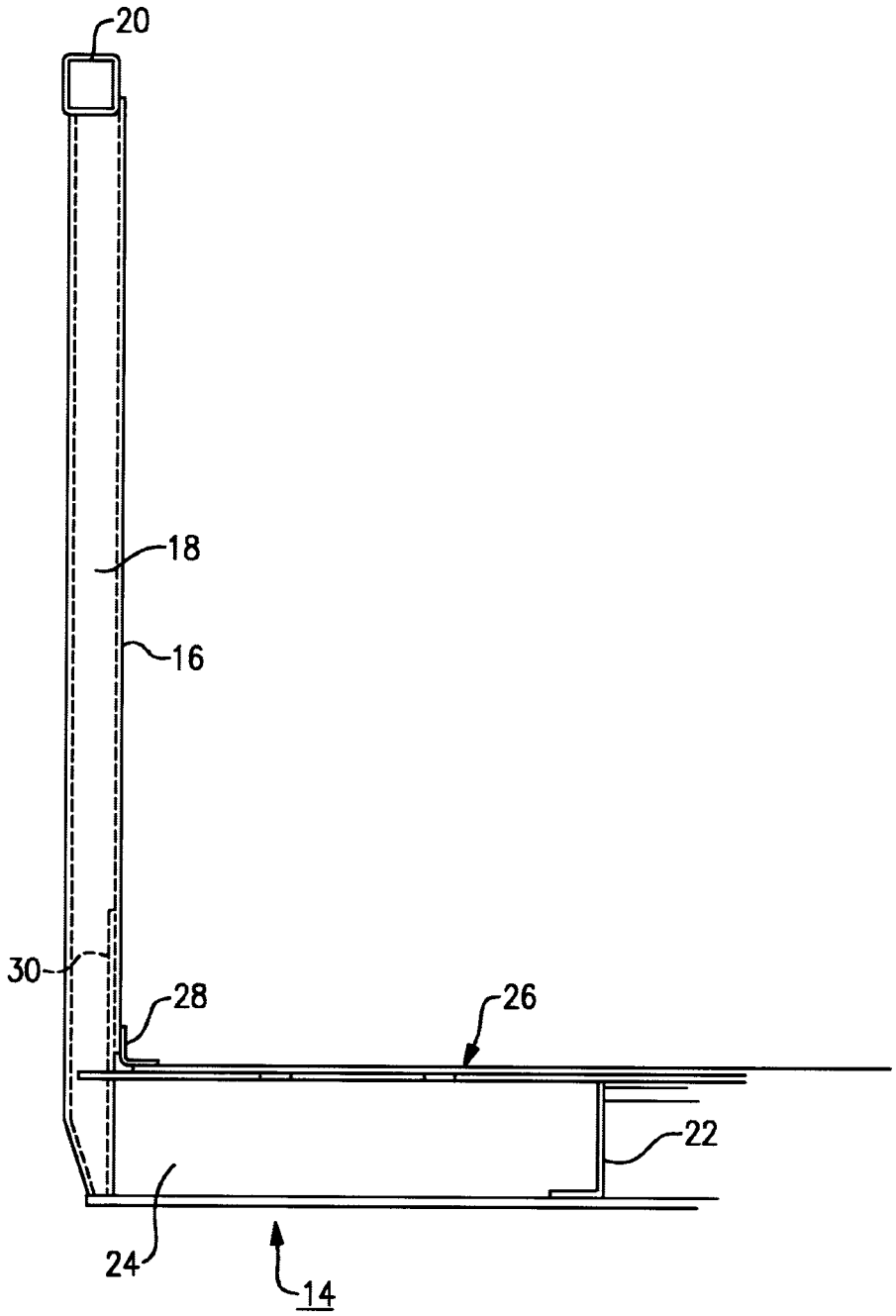
Figure 3:
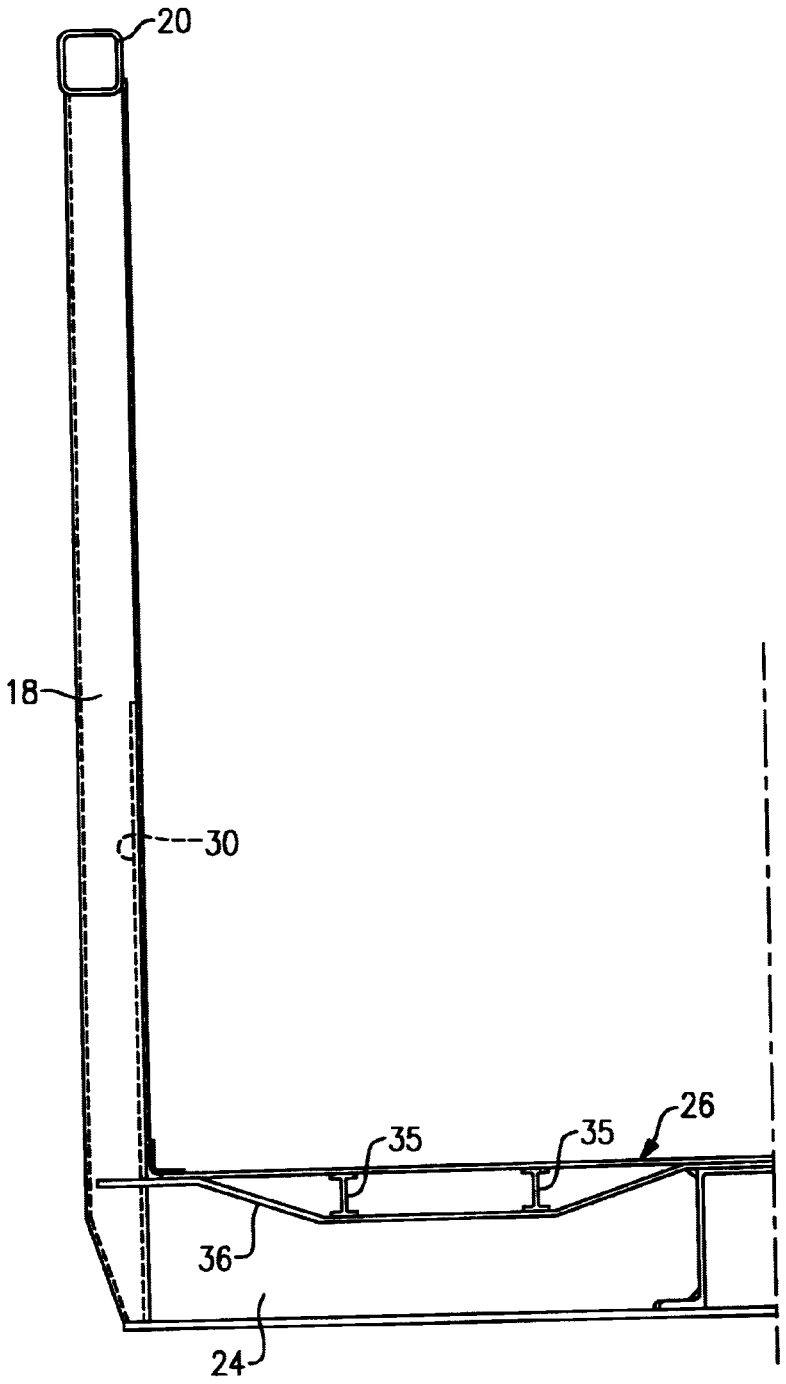
Figure 4:
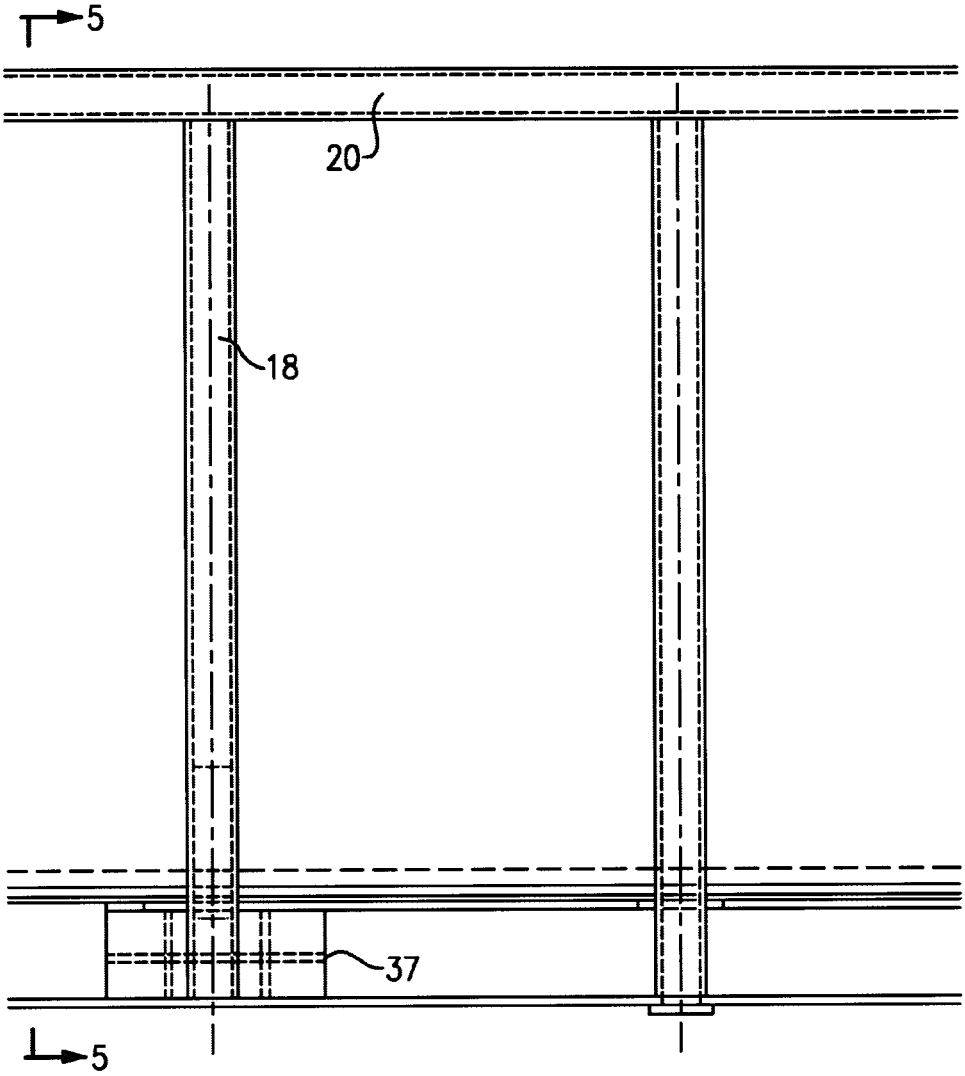
Figure 5:
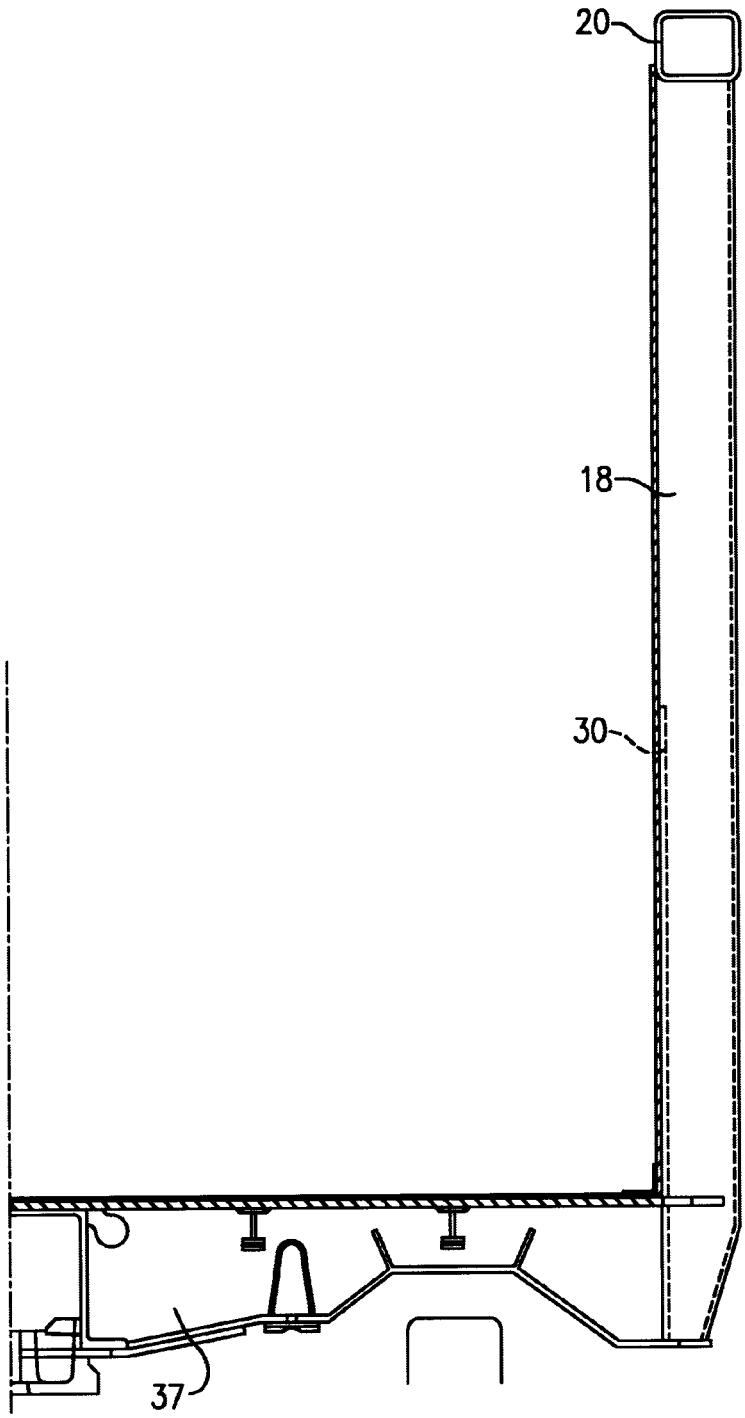
Figure 6:
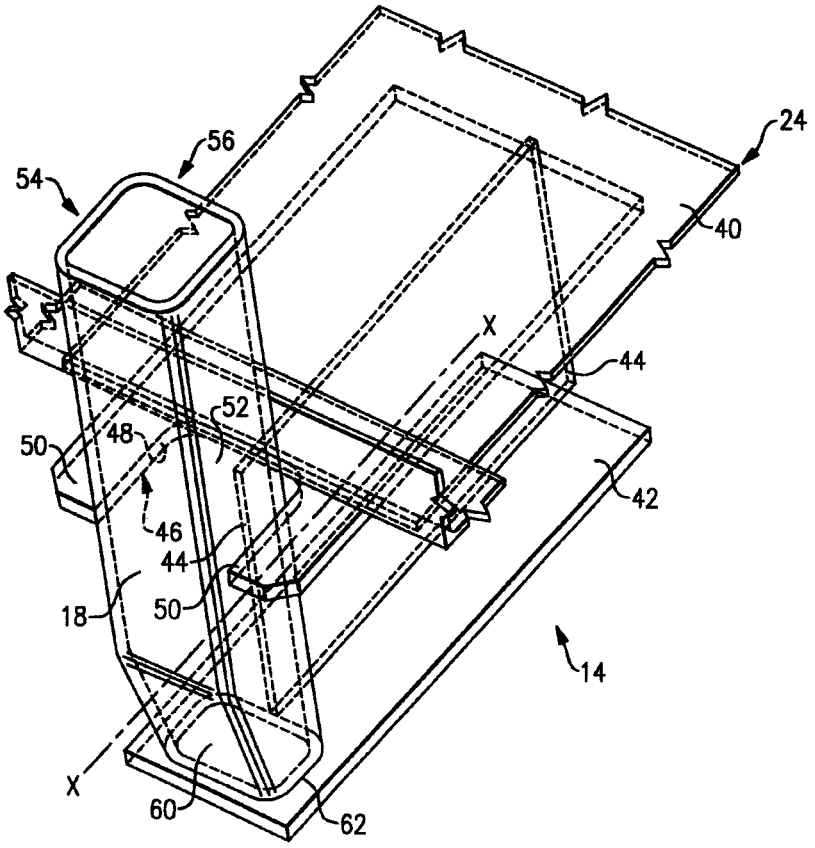
Figure 7:
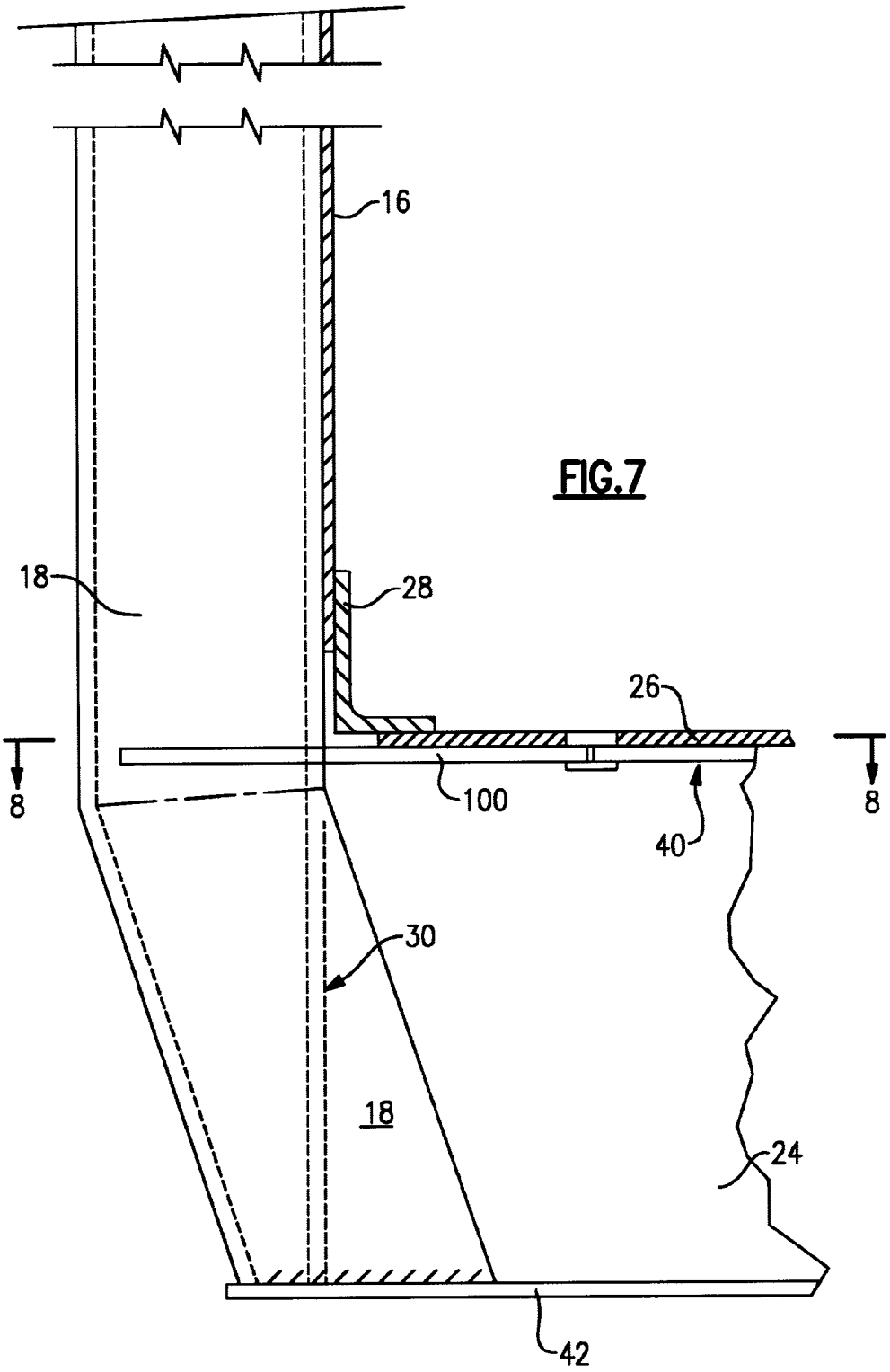
Figure 8:
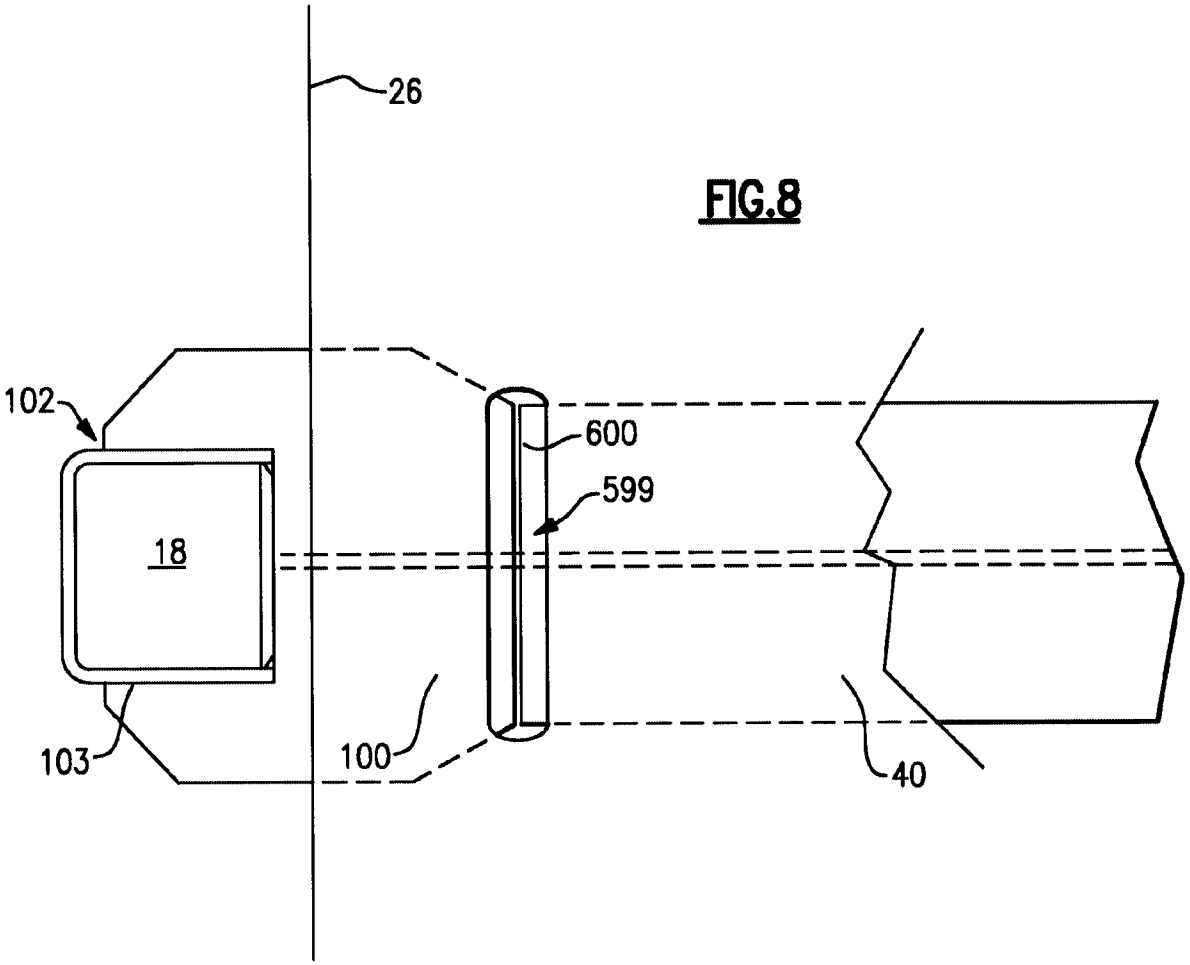
Figure 9:
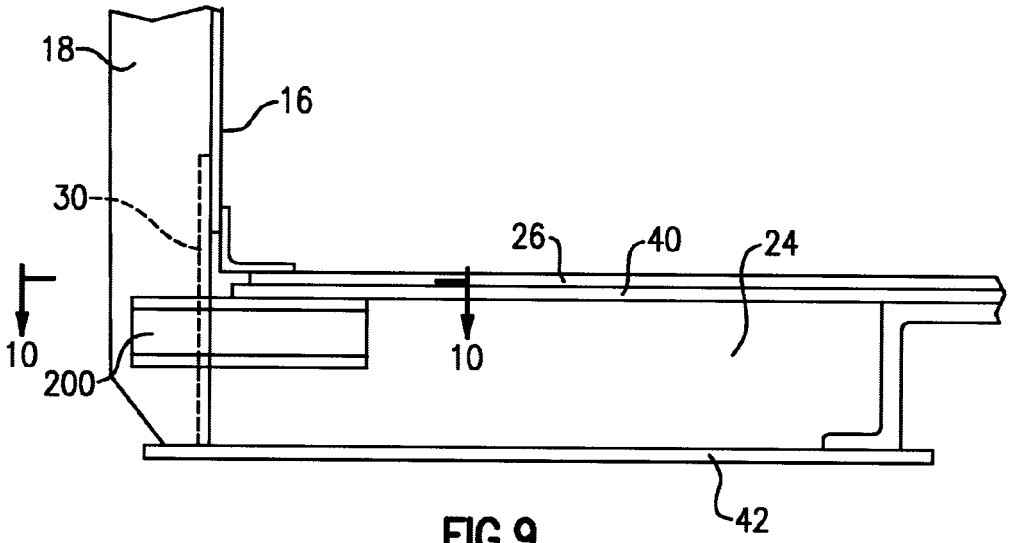
Figure 10:
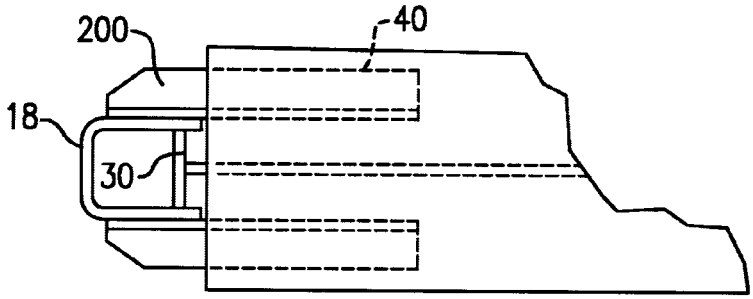
Figure 11:
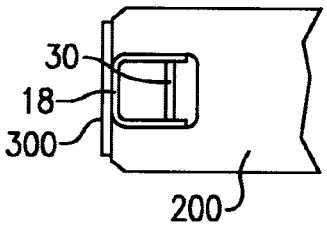
Figure 12:
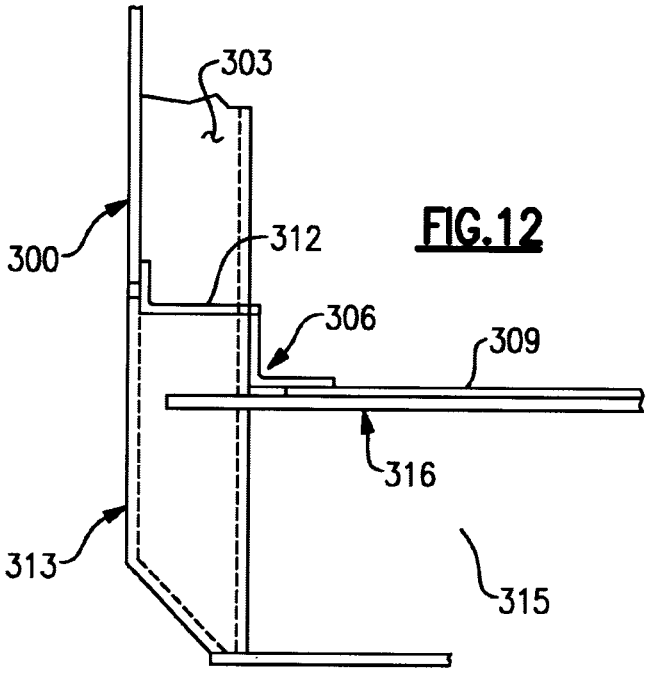
Figure 13:
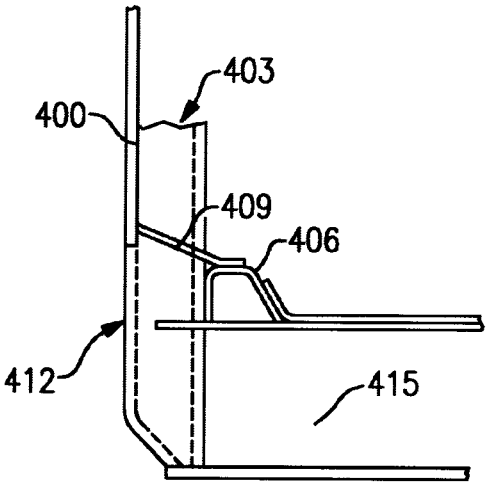
Figure 14:
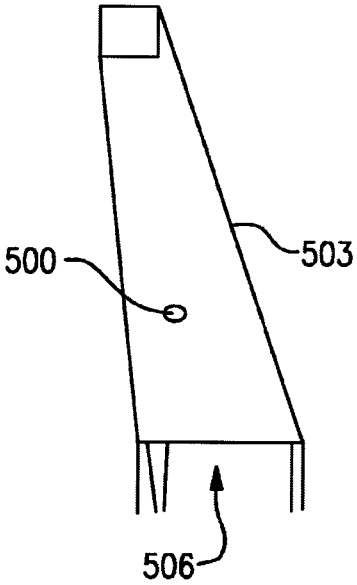

Turning to FIG. 14, a side view of a tapered post 500 is shown. For an outside post configuration, an angled surface 503 resulting from the taper provides support for angled inner walls of the railcar. At the bottom 506 of the post 500, the post 500 connects to the cross bearing member (not shown) in the manner described above.

Accordingly, the present invention provides a simple yet highly efficient connection between the side and the underframe of a gondola railcar. Also, as a result the railcar of the present invention requires no interior bracing to support the side against lateral load.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A railcar subassembly, comprising:

a horizontal cross-bearing member having a longitudinal axis, a top flange, and a bottom flange, the top flange and bottom flange connected by at least one vertical web, the cross-bearing member formed at a first end such that the flanges extend beyond the web along the longitudinal axis, the top flange having an opening defined therein that is bordered by an inner edge of the top flange; and, a side post having a side wall and an end portion, the side post disposed through the opening in the top flange of the beam such that the side wall abuts with the inner edge of the top flange, abuts with the web, and an end portion of the side post abuts with the bottom flange.

2. The railcar subassembly of claim 1, wherein the top flange is integrally formed in the cross-bearing member.

3. The railcar subassembly of claim 1, wherein a portion of the top flange with the opening is a separate member capable of being attached to the cross-bearing member.

4. The railcar subassembly of claim 1, wherein the side post is tapered.

5. The railcar subassembly of claim 1, wherein the side post supports angled side walls on a gondola railcar.

6. The railcar subassembly of claim 1, further comprising:

a reinforcing member disposed inside the post along an area of the post where it is connected to the cross-bearing member.

7. The railcar subassembly of claim 1, further comprising an auxiliary support member attached to the top flange such that the side post is completely surrounded by the top flange and the auxiliary support member when the side post is disposed through the opening in the flange.

8. The railcar subassembly of claim 1, wherein the side post is welded to the inner edge of the top flange.

9. The railcar subassembly of claim 1, wherein the side post is welded to the at least one vertical web.

10. The railcar subassembly of claim 1, wherein the end portion of the side post is welded to the bottom flange.

11. A railroad car, comprising:

a subframe assembly including a plurality of horizontal cross-bearing members having a longitudinal axis, a top flange, and a bottom flange, the top flange and bottom flange connected by at least one vertical web, the cross-bearing member formed at a first end such that the flanges extend beyond the web alone the longitudinal axis, the top flange having an opening defined therein that is bordered by an inner edge of the top flange;

a side structure having a side sheet having inner and outer surfaces and a plurality of vertical side posts disposed adjacent to the side sheets; and, at least one of the side posts connected to the cross-bearing member and disposed through the opening in the upper flange of the cross-bearing member such that the post abuts with the opening and the vertical web, the side post having an end portion that abuts with the lower flange of the cross-bearing member.

12. The railroad car of claim 11, further comprising a reinforcing member disposed inside the side posts and extending from the underframe to the side structure.

13. The railroad car of claim 11, wherein the top flange is integrally formed in the cross-bearing member.

14. The railroad car of claim 11, wherein a portion of the top flange having an opening is a separate member capable of being attached to the cross-bearing member.

15. The railroad car of claim 11, wherein the side posts are disposed adjacent to an outer surface of the side sheets.

16. The railroad car of claim 11, wherein the side posts are disposed adjacent to an inner surface of the side sheets.

17. The railroad car of claim 11, wherein the side posts are tapered.

18. The railroad gondola car of claim 17, wherein the side post supports angled side walls.

* * * * *

UNITED STATES PATENT AND TRADEMARK OFFICE

CERTIFICATE OF CORRECTION

PATENT NO. : 6,978,720 B2 
APPLICATION NO. : 10/695558
DATED : December 27, 2005
INVENTOR(S) : Kent N. Johnson It is certified that error appears in the above-identified patent and that said Letters Patent is hereby corrected as shown below:

Title page should be deleted and substitute therefore the attached title page.

Drawings:

Delete drawings Figs. containing Figs 1-14 and substitute therefore drawings consisting of Figs.1-14 as shown on the attached pages Signed and Sealed this Twenty-fourth Day of October, 2006

JON W. DUDAS
*Director of the United States Patent and Trademark Office*

(12) United States Patent
Johnson

(10) Patent No.: US 6,978,720 B2
(45) Date of Patent: Dec. 27, 2005

(54) GONDOLA RAILCAR CONSTRUCTION

(76) Inventor: Kent N. Johnson, 178 Seven Forks Rd., Martin, GA (US) 30557

( * ) Notice: Subject to any disclaimer, the term of this patent is extended or adjusted under 35 U.S.C. 154(b) by 0 days.

(21) Appl. No.: 10/695,558

(22) Filed: Oct. 28, 2003

(65) Prior Publication Data

US 2005/0087097 A1 Apr. 28, 2005

(51) Int. Cl.[7] ..... B61D 3/00

(52) U.S. Cl. ..... 105/380; 105/406.1; 105/411; 105/419

(58) Field of Search ..... 105/380, 381, 105/382, 383, 384, 385, 386, 787, 389, 390, 105/392, 406.1, 411, 419; 52/436.2, 736.1, 52/737.2, 726.3, 726.1, 726.9

(56) References Cited

U.S. PATENT DOCUMENTS

| | | | | |
|---|---|---|---|---|
| 821,490 | A * | 5/1906 | Herrmann | 105/380 |
| 827,266 | A * | 7/1906 | Sage | 105/380 |
| 860,029 | A * | 7/1907 | Irwin | 105/380 |
| 1,261,604 | A * | 4/1918 | Pearson | 105/380 |
| 3,605,634 | A | 9/1971 | Johnson | |
| 3,605,635 | A | 9/1971 | Stark | |
| 3,769,918 | A | 11/1973 | Przyblinski et al. | |
| 3,866,545 | A | 2/1975 | Heap | |
| 4,356,776 | A | 11/1982 | Brodeur et al. | |
| 4,417,526 | A | 11/1983 | Marulic et al. | |
| 5,341,747 | A | 8/1994 | Fetterman et al. | |
| 5,388,529 | A | 2/1995 | Tieberghien et al. | |
| 5,813,353 | A | 9/1998 | Sauter | |

* cited by examiner

*Primary Examiner*—Mark T. Le
(74) *Attorney, Agent, or Firm*—Hodgson Russ LLP

(57) ABSTRACT

A gondola railcar having a plurality of side posts connected to the underframe for a high strength construction. The underframe includes a plurality of cross-bearing members having an upper flange, a lower flange and at least one vertical web connecting the two flanges. The upper flange has an opening disposed therein that receives the side post such that the side post abuts with the upper flange inside the opening. The side post also abuts with an end of the vertical web, and an end portion of the side post abuts with the lower flange of the cross-bearing member.

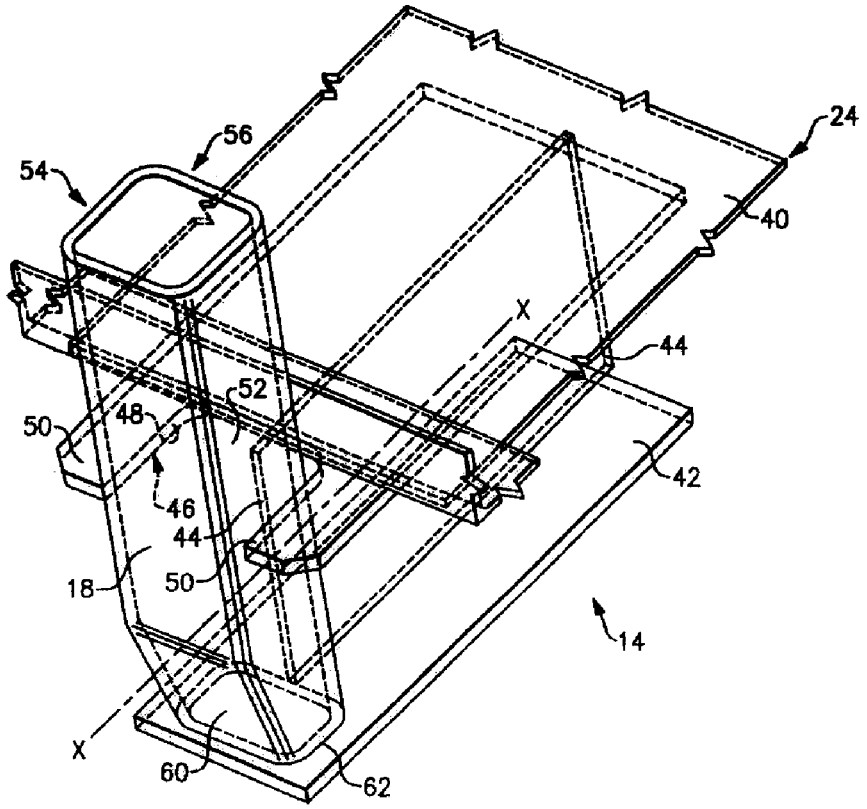

18 Claims, 10 Drawing Sheets